US005222658A

United States Patent [19]

DeMaio et al.

[11] Patent Number: 5,222,658

[45] Date of Patent: Jun. 29, 1993

[54] DUAL SLOT-STRAP HANDLE FOR CAN CARTON

[75] Inventors: James B. DeMaio, Marietta; James T. Stout, Sr., Ellijay, both of Ga.

[73] Assignee: The Mead Corporation, Dayton, Ohio

[21] Appl. No.: 912,390

[22] Filed: Jul. 13, 1992

[51] Int. Cl.[5] ..... B65D 5/46

[52] U.S. Cl. ..... 229/117.13; 206/427

[58] Field of Search ..... 229/117.13, 40; 206/141, 427

[56] References Cited

U.S. PATENT DOCUMENTS

| | | | |
|---|---|---|---|
| Re. 33,110 | 11/1989 | Wood et al. | 229/117.13 |
| 2,718,301 | 9/1955 | Palmer . | |
| 2,723,027 | 11/1955 | Guyer . | |
| 2,785,847 | 3/1957 | Forrer | 229/117.13 |
| 3,540,581 | 11/1970 | Koolnis . | |
| 3,994,432 | 11/1976 | Kirby, Jr. | 229/117.13 |
| 4,340,170 | 7/1982 | Montealegre | 229/117.13 |
| 4,405,078 | 9/1983 | Dutcher et al. | 229/117.13 |
| 4,498,619 | 2/1985 | Roccaforte | 229/117.13 |
| 4,558,816 | 12/1985 | Wood | 229/117.13 |
| 4,582,199 | 4/1986 | Schuster | 206/428 |
| 4,681,252 | 7/1987 | Doerr et al. | 229/117.13 |
| 4,785,991 | 11/1988 | Schuster | 206/141 |
| 4,811,894 | 3/1989 | Schuster | 229/117.13 |
| 4,966,324 | 10/1990 | Steel | 206/427 |
| 4,974,771 | 12/1990 | Lavery | 206/141 |

FOREIGN PATENT DOCUMENTS

| | | | |
|---|---|---|---|
| 877792 | 8/1971 | Canada | 229/117.13 |
| 1036562 | 8/1978 | Canada | 229/117.13 |
| 2052618 | 5/1971 | Fed. Rep. of Germany . | |
| 1103372 | 2/1968 | United Kingdom | 206/141 |

*Primary Examiner*—Gary E. Elkins
*Attorney, Agent, or Firm*—Tsugihiko Suzuki

[57] ABSTRACT

A carrying handle arrangement for a can carton having interconnected top, bottom and side walls and end closure panels is provided with a carrying handle arrangement. The arrangement includes a pair of spaced transverse generally parallel flaps formed in the top wall and a pair of spaced stress relieving slits formed in each side wall. The flaps are arranged such that a portion of the top wall between the flaps is located medially between the opposite end edges of the top wall. At least one of the side edges of each flap is arranged to function as a fold line. The opposite ends of each flap is defined by a pair of end slits are arranged to interconnect the adjacent ends of the side edges respectively. The stress relieving slits intersect a junction between the respective side wall and the top wall and extend into the top wall. Each stress relieving slit extends along the top wall to a point on the adjacent end slit.

17 Claims, 5 Drawing Sheets

DUAL SLOT-STRAP HANDLE FOR CAN CARTON

BACKGROUND OF THE INVENTION

This invention generally relates to can cartons and more particularly to carrying handles for such cartons.

U.S. Pat. No. 4,558,816 issued Dec. 17, 1985 and owned by the assignee of this invention discloses a carrying handle for a can carton which includes a pair of flaps closing a finger receiving slot formed in the top wall of the carton. Slits project from the ends of the slot and down into the carton side walls. The flaps are foldable inwardly of the carton to open the slot in the top wall and to form a cushion for the hand of a user carrying the carton. Such flaps must be arranged midway between two adjacent cans inside the carton so that the space between the two cans accommodates the fingers of a user when the fingers are inserted through the slot. This, in other words, means that it depends on the number of cans within a carton whether the finger receiving slot can be defined in the mid location on the top wall of the carton to thereby allow the carton to be well balanced when it is held by the slot edge.

In a typical fifteen-can carton, for example, wherein cans with horizontal axes are arranged in three tiers of five cans each, the slot cannot be formed in the mid location but in a location offset therefrom. This offset location of the slot causes inconvenience depending on which one of the longitudinal edges of the slot a user grips when he or she carries the carton. More particularly, when one of the longitudinal edges were gripped, the carton would be tilted in the direction of the tips of the user's fingers, which makes the grip on the carton less stable or which necessitates the user to grip the other edge of the slot.

What is needed, therefore, is a carrying handle for a can carton having a finger receiving slot, which is particularly adapted for positioning the slot offset from the carton wall midpoint. Such a handle should allow a stable grip regardless of which one of the edges of the slot a user grips.

SUMMARY OF THE INVENTION

According to this invention in one form, a can carton having interconnected top, bottom and side walls and end closure panels is provided with a carrying handle arrangement. This arrangement includes a pair of spaced transverse generally parallel flaps formed in the top wall and a pair of spaced stress relieving slits formed in each side wall. The flaps are arranged such that a portion of the top wall between the flaps is located medially between the opposite end edges of the top wall. Each flap is arranged approximately midway between two adjacent cans and has a pair of spaced transverse generally parallel side edges. At least one of the side edges of each flap is arranged to function as a fold line. The opposite ends of each flap is defined by a pair of end slits arranged to interconnect the adjacent ends of the side edges respectively. The stress relieving slits intersect a junction between the respective side wall and the top wall and extend into the top wall. Each stress relieving slit extends along the top wall to a point on the adjacent end slit.

According to a feature of the invention, either side edge of each flap may be arranged to function as a fold line, and each flap may be provided with a medial perforated slit which extends between the end slits of the corresponding flap and divides the same flap into a pair of flap portions each foldable along the fold line.

According to another feature of the invention, one of the side edges of each flap may be arranged to function as a severance line so that each flap is foldable inwardly along the other side edge which functions as a fold line.

DETAILED DESCRIPTION OF THE PREFERRED EMBODIMENT

Figure 1:
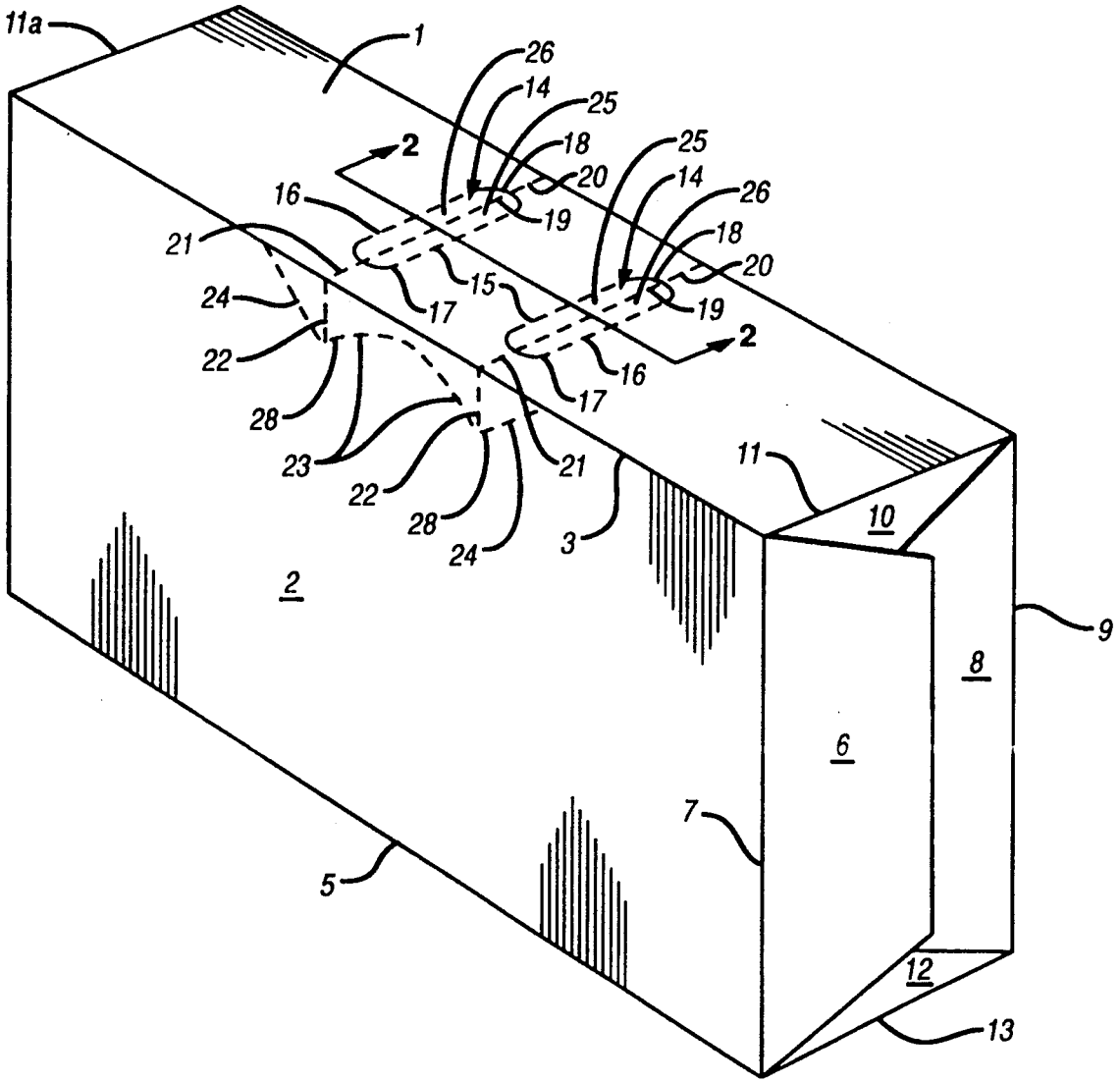
FIG. 1 is a perspective view of a loaded set-up can carton which embodies the carrying handle of this invention.
Figure 2:
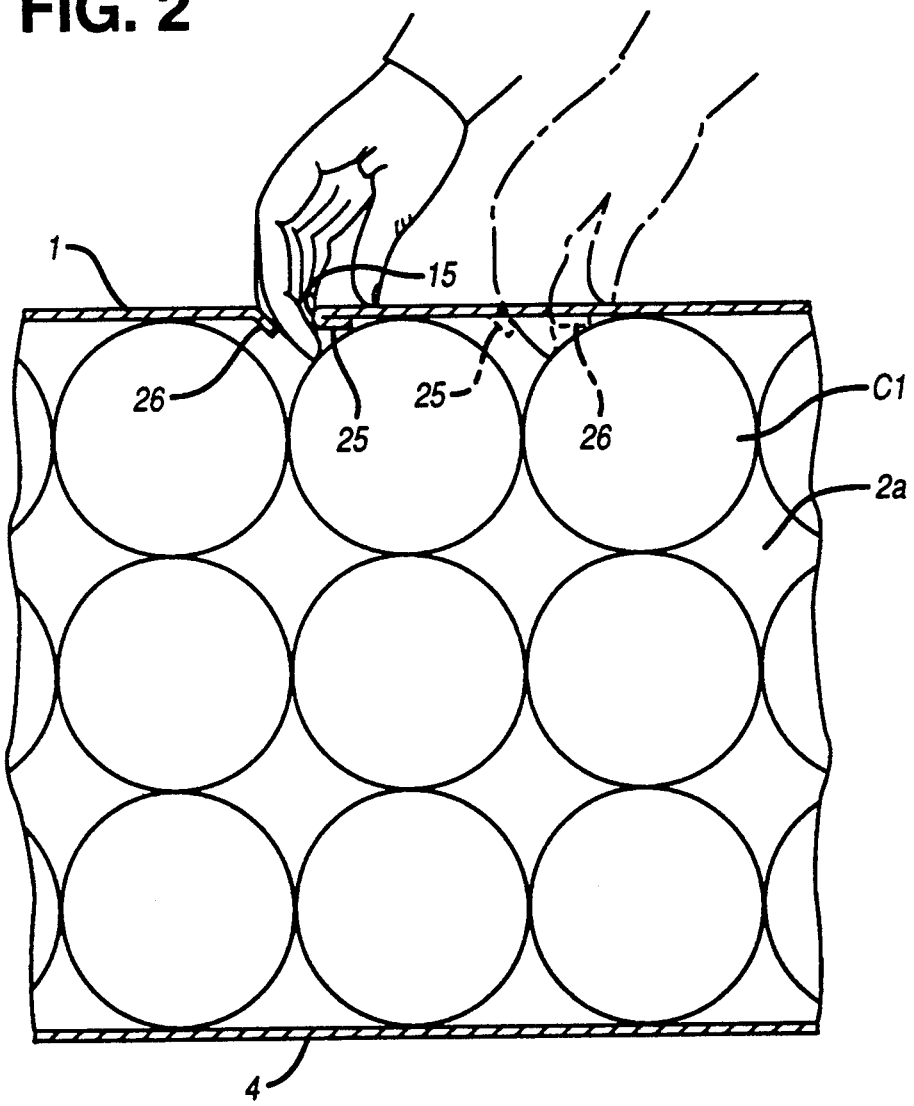
FIG. 2 is a cross sectional view taken along the lines 2—2 in FIG. 1.

With reference to FIG. 1, the can carton includes a top wall designated by the reference numeral 1 to which a side wall designated by the numeral 2 is foldably joined along a fold line 3. A bottom wall 4 as shown in FIG. 2 is foldably joined to the side wall 2 along a fold line 5 and to a side wall 2*a* opposite from the side wall 2 which is not observable in FIG. 1, a fragment of which appears in FIGS. 2 and 5.

The closure panels for both ends of the carton are identical. As is apparent from FIGS. 1 and 3, a panel 6 is foldably joined to the side wall 2 along a fold line 7 while a panel 8 is foldably joined along a fold line 9 to the side wall 2*a*. An end flap 10 is foldably joined to the top wall 1 along a fold line 11 while an end flap 12 is foldably joined to the bottom wall 4 along a fold line 13. The flaps 6, 8, 10 and 12 are secured in overlapping relation as shown in FIG. 1 and secured by known means to form an end closure for the carton.

Figure 3:
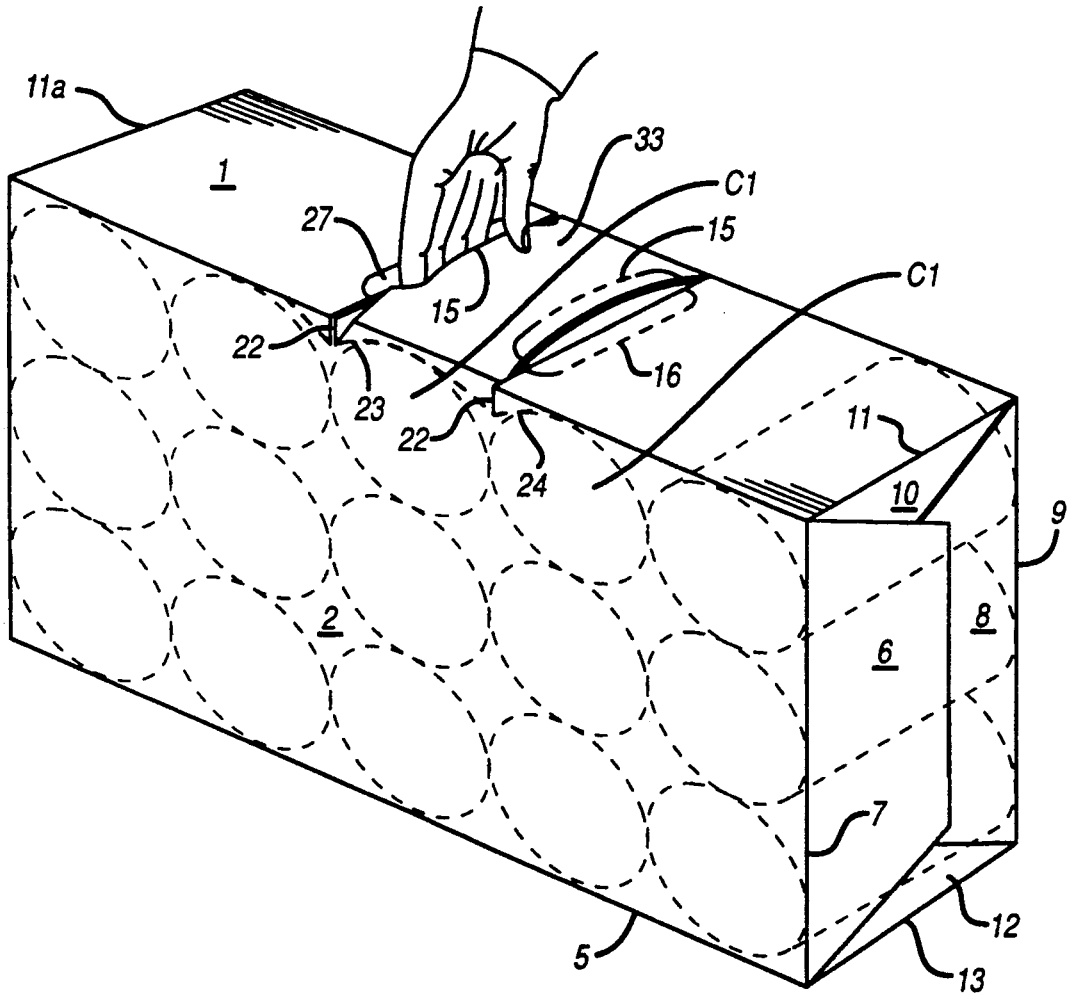
FIG. 3 is a view similar in some respects to FIG. 1 but which shows the carton in a lifted condition and depicts the function of the handle strap and of parts associated therewith.
Figure 4:
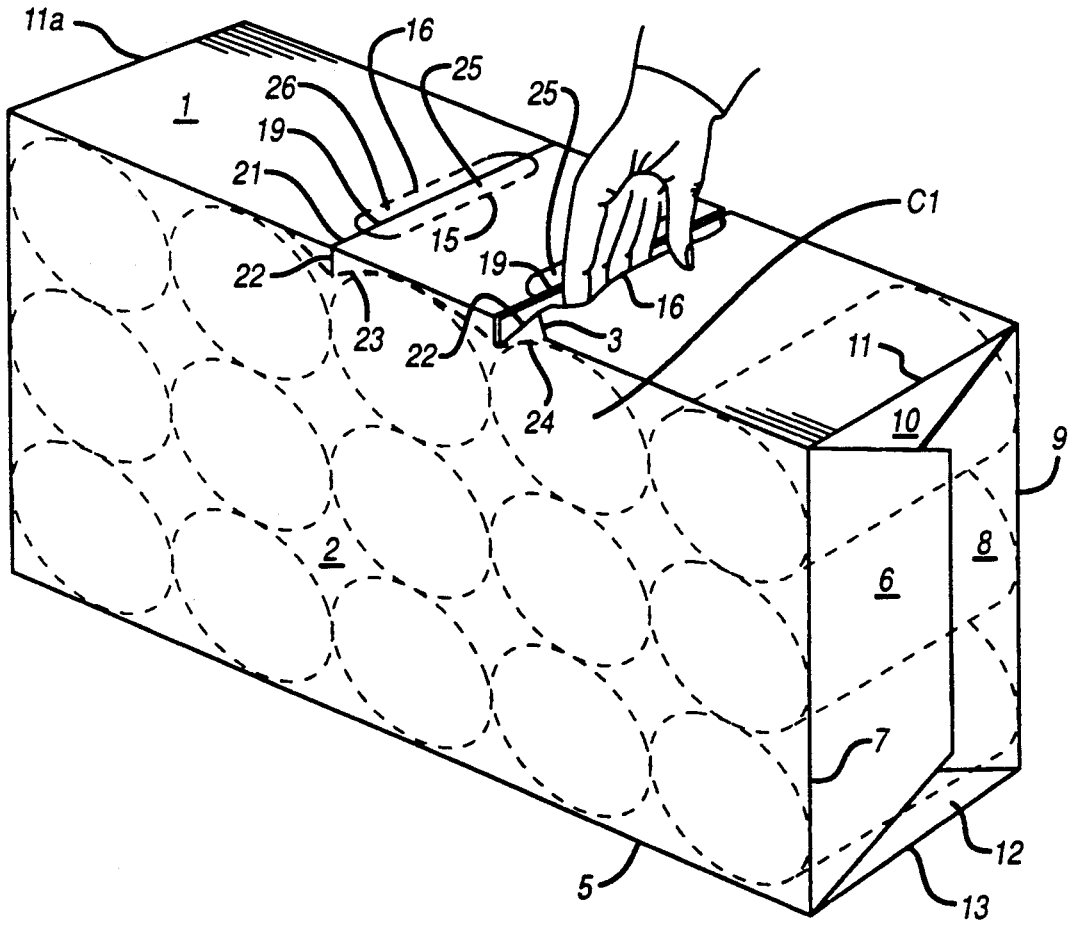
FIG. 4 is a view similar in some respects to FIG. 3 but which shows the carton in another lifted condition and depicts the function of the flaps and of parts associated therewith.

As is apparent from FIGS. 3 and 4, in the depicted embodiment, three tiers of five cans each are disposed within the carton and arranged with their axes horizontal and in parallel relation to each other.

With reference to FIG. 1, a pair of transverse flaps generally designated by reference numeral 14 are formed in the top wall 1. These transverse flaps 14 are arranged in a spaced and parallel relation to each other. The location of these flaps 14 are such that the portion of the top wall 1 between the flaps 14 is disposed medially between the opposite end edges 11 and 11*a* of the top wall 1. Each flap 14 is disposed approximately midway between two adjacent cans C1 as best shown in FIG. 2. Each flap 14 is defined by a pair of spaced parallel side edges 15 and 16 together with a pair of arcuate end slits 17 and 18.

In accordance with one form of the invention, the side edges 15 and 16 of each flap 14 are defined by perforated slits which function as fold lines. A longitudinal medial perforated slit 19 is formed in each flap 14. This slit 19 extends between the end slits 17 and 18 and divides the respective flap 14 into a pair of identical and complementary handle flap portions 25 and 26.

Disposed in the top panel 1 and interconnected at approximately the mid point of each of the arcuate slits 17 and 18 of the flaps 14 are stress relieving slits 20 and 21. Each of these stress relieving slits intersects the fold line between the top wall 1 and the adjacent side wall and extends into the adjacent side wall as indicated at 22 in connection with the stress relieving slit 21.

The lower end of each stress relieving slit such as 22 formed in the side wall 2 is interconnected by an arcuate terminal slit 28 with a pair of weakened fold lines such as 23 and 24. These fold lines 23 and 24 are disposed on the opposite sides of the stress relieving slit 22 and diverge from each other toward the fold line 3 between the top wall 1 and the side wall 2. In FIG. 1, the respective upper portions of the fold lines 23 in the side wall 2 are arcuately curved toward each other and are joined together. Of course similar structure to elements 22–24 and 28 is formed in the side wall 2*a* which is opposite the side wall 2. The point of intersection of the stress relieving slit such as 22 with the junction such as 3 between the top wall 1 and each of the side walls such as 2 is aligned longitudinally with the adjacent slit 19 but is offset longitudinally from the adjacent fold lines 15 and 16 so as to facilitate dispersal of stress in the side walls 2 and 2*a* and thereby to minimize the possibility of tearing of the side walls.

Figure 5:
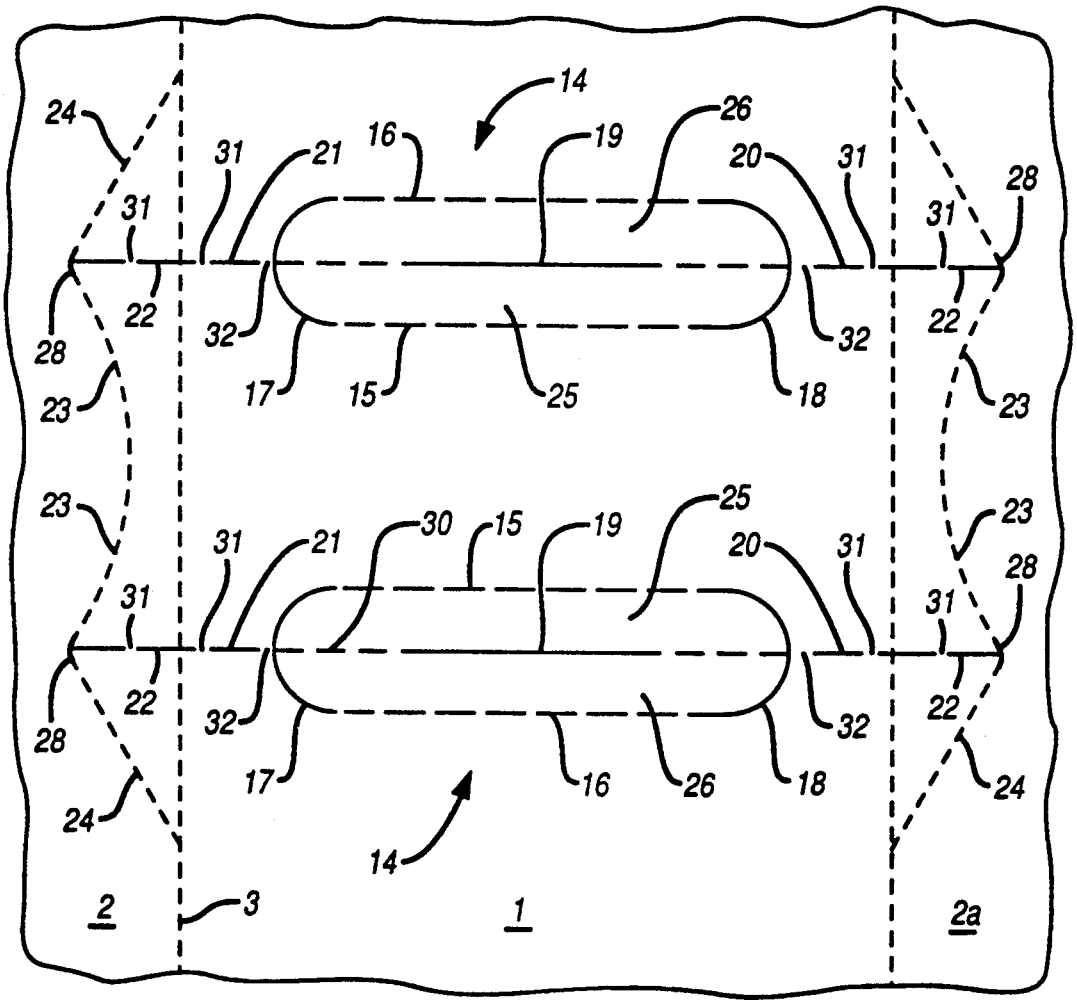
FIG. 5 is an enlarged part of a portion of a blank from which the carton is formed.

As best shown in FIG. 5, the medial perforated slit 19 and the stress relieving slits 20 and 21 are formed of a plurality of perforations such as are indicated at 30 which are interspersed between imperforate portions 31. According to one feature of the invention, imperforate portions 32 which are interposed between the slit 19 and the slit 20, and the slit 19 and the slit 21 respectively are approximately twice as long as the remaining imperforate portions such as 31. These longer imperforate portions 32 have been constructed in a practical embodiment of the invention and are one-eighth of an inch in length while other imperforate portions such as 31 are approximately one-sixteenth inch in length.

The number of the imperforate portions 31 of the medial perforated slit 19 may be less than that of the imperforate parts of the perforated fold lines 15 and 16 so that downward pressure on the flap portions 25 and 26 adjacent the perforated slit 19 ruptures that perforated slit 19 and allows the flap portions 25 and 26 to be folded downwardly in opposite directions to cause a transverse slot 27 to be defined in the top wall 1 as shown in FIG. 3.

While the fold lines 15 and 16 are shown as formed by perforated slits similar to the perforated slit 19, it will be understood that these fold lines could simply constitute somewhat weakened areas formed in conventional fashion such as the weakened fold lines 23 and 24.

In using the carrying handle of this invention to lift and carry the carton, the fingers of a user are inserted against the flap portion such as 25 of either of the flaps 14 into the respective slot 27 as shown in FIG. 2. This operation causes the flap portion 25 to swing inwardly about its fold line 15 through an angle of approximately 180° to occupy a position of flat face contacting relation with the inner surface of the top wall 1 as shown in FIG. 2. By this structure, the flap portion 25 effectively reinforces the top wall 1 and affords a cushion along the fold line or side edge 15, which protects the hand of the user. This operation may be accompanied by a downward bending of the flap portion 26 so as to facilitate entry of the user's fingers into the slot 27 whereby folding of the flap portion 25 may be effected.

Lifting of the carton by holding near the side edge 15 of one of the flaps 14 causes the perforated slits 19, 20, 21 and 22 associated with the other flap 14 to rupture. This operation results in formation of a strap handle 33 transversely extending between the side walls 2 and 2*a* as shown in FIG. 3. Stated more particularly, the portion of each side wall between the stress relieving slits 22 collapses into the carton whereas the portion of the top wall 1 between the flaps 14 are raised over the remainder of the top wall 1. This strap-forming operation results in a distribution of the load over a wide area of the carton side walls. Preferably, the fold line 23 is disposed along the end of the adjacent can C1. Such a strap handle 33 is disposed medially between the end edges of the top wall 1, and therefore the carton, when held by the strap handle, is balanced such that the top wall 1 is disposed horizontally.

Alternatively, the fingers of a user may be inserted against the flap portion 26 of either of the flaps 14 as shown by the dot-and-dash line in FIG. 2. By this operation, the flap portion 26 is folded in a manner similar to what is described above with respect to the flap portion 25 and thereby affords a cushion along the fold line or side edge 16.

Lifting of the carton by holding near the side edge 16 causes an inward bending of the triangular structure defined by the slit 22, the fold line 24 and the fold line 3 inwardly against the end of an associated can as represented in FIG. 4. This folding operation also results in a distribution of the load over a wide area of the carton side walls. Preferably, the fold line 24 is disposed approximately tangentially with respect to the end of the adjacent can C1. Although lifting of the carton by holding near the side edge 16 also causes the carton to be tilted in the direction away from the finger tips of a user, it is of no inconvenience as far as stable grip on the carton is concerned.

Although in the foregoing embodiment, the carrying handle is used with a carton containing an odd number of cans in the topmost row (i.e., five), it may also be used with cartons for packaging even numbers of cans in the topmost row. The flaps 14 may also be positioned such that more than one can is disposed between the flaps 14.

In accordance with another form of the invention, the medial perforated slit 19 of each flap 14 is replaced with a fold line whereas one of the side edges 15 and 16 of each flap 14 is defined by a perforated severance line. The structure of each flap of such a carrying handle is described in further detail in U.S. Pat. No. 4,681,252 owned by the assignee of this invention, which is hereby incorporated in this application by reference.

Other slot handle arrangements, for example, those disclosed in U.S. Pat. Nos. 4,340,170; 4,405,078; 4,811,894; and Re. 33,110, may also be used in the present invention in place of the disclosed arrangement of flaps 14.

Having described the invention in detail and by reference to the preferred embodiment thereof, it will be apparent that modification and variation are possible without departing from the scope of the invention defined in the appended claims.

What is claimed is:

1. A package comprising:

a plurality of generally cylindrical articles arranged into a group of at least one tier, each of said articles having opposite ends, each having a generally circular perimeter, said articles in said one tier being disposed side-by-side with the axes thereof disposed horizontally and parallel to each other; and a carton disposed around the exterior of said group of said articles and comprising a top and a pair of side walls, said side walls being disposed adjacent respectively to said opposite ends of said articles of said group along said opposite ends, said top wall being disposed over said group of said articles, said top wall having a pair of side edges and opposite end edges, said top wall being foldably joined at said side edges thereof to said side walls, said top wall having a pair of spaced generally parallel flaps formed therein for defining finger-receiving slots in said top wall, each of said flaps extending transversely of said top wall, said flaps being arranged such that a portion of said top wall between said flaps is located medially between said end edges of said top wall, each of said flaps being arranged approximately midway between two adjacent ones of said articles in said one tier and being defined by a pair of spaced generally parallel first fold lines extending transversely of said top wall, opposite ends of each of said flaps being defined by a pair of end slits interconnecting adjacent ends of said first fold lines respectively, each of said flaps is formed with a medial perforated slit extending between said end slits of the respective flap, said perforated slit dividing the respective flap into a pair of flap portions, each of aid side walls having a pair of spaced stress relieving slits and a second fold line, each of said stress relieving slits having a lower extremity, each of said stress relieving slits intersecting a junction between the respective side wall and said top wall and extending into said top wall, each of said stress relieving slits extending along said top wall to a point on an adjacent one of said end slits, said second fold line interconnecting said lower extremities of said stress relieving slits in said each side wall, said second fold line extending along at least a part of said circular perimeter of an adjacent one of said articles.

2. A package according to claim 1 wherein points of intersection between said stress relieving slits and said junction between the respective side wall and said top wall are aligned respectively with parts of said flaps intermediate their respective first fold lines.

3. A package according to claim 1 wherein said point on said adjacent one of said end slits to which each of said stress relieving slits extends is positioned intermediate said first fold lines of the respective flap.

4. A package according to claim 1 wherein each of said end slits is of arcuate configuration.

5. A package according to claim 1 wherein a pair of terminal slits are formed in each of said side walls and are disposed respectively at said extremities of said stress relieving slits in such a manner that said terminal slits respectively intersect said stress relieving slits, and said second fold line in each of said side walls interconnects said terminal slits in the respective side wall.

6. A package according to claim 1 wherein a pair of third fold lines are formed in each of said side walls, said third fold lines extending outwardly of said each side wall respectively from said extremities of said stress relieving slits toward said junction between the respective side wall and said top wall.

7. A package according to claim 6 wherein each of said third fold lines is disposed in substantially tangential relation with said circular perimeter of one of said ends of an adjacent one of said articles.

8. A package according to claim 1 wherein said flap portions are joined to said top wall for inward folding movement about said first fold lines to position said flap portions in flat face contacting relation with an inner surface of said top wall to form a respective one of said finger receiving slots in said top wall and to reinforce said top wall.

9. A package comprising:

a plurality of generally cylindrical articles arranged into a group of at least one tier, each of said articles having opposite ends, each having a generally circular perimeter, said articles in said one tier being disposed side-by-side with the axes thereof disposed horizontally and parallel to each other; and a carton disposed around the exterior of said group of said articles and comprising a top and a pair of side walls, said side walls being disposed adjacent respectively to said opposite ends of said articles of said group along said opposite ends, said top wall being disposed over said group of said articles, said top wall having a pair of side edges and opposite end edges, said top wall being foldably joined at said side edges thereof to said side walls, said top wall having a pair of spaced generally parallel flaps formed therein for defining finger-receiving slots in said top wall, each of said flaps extending transversely of said top wall, said flaps being arranged such that a portion of said top wall between said flaps is located medially between said end edges of said top wall, each of said flaps being arranged approximately midway between two adjacent ones of said articles in said one tier and being defined by a pair of spaced generally parallel lines extending transversely of said top wall, opposite ends of each of said flaps being defined by a pair of end slits interconnecting adjacent ends of said parallel lines respectively, one of said parallel lines of each of said flaps being a first fold line, the other of said parallel lines being a severance line, each of said side walls having a pair of spaced stress relieving slits having a lower extremity, each of said stress relieving slits having a lower extremity, each of said stress relieving slits intersecting a junction between the respective side wall and said top wall and extending into said top wall, each of said stress relieving slits extending along said top wall to a point on an adjacent one of said end slits, said second fold line interconnecting said lower extremities of said stress relieving slits in said each side wall, said second fold line extending along at least a part of said circular perimeter of an adjacent one of said articles.

10. A package according to claim 9 wherein both of said parallel lines of each of said flaps are perforated slits.

11. A package according to claim 9 wherein each of said flaps is joined to said top wall for inward folding movement about said first fold line to position the respective flap in flat face contacting relation with an inner surface of said top wall to form a respective one of said finger-receiving slots in said top wall and to reinforce said top wall.

12. A package according to claim 9 wherein points of intersection between said stress relieving slits and said junction between the respective side wall and said top wall are aligned respectively with parts of said flaps intermediate their respective parallel lines.

13. A package according to claim 9 wherein said point on said adjacent one of said end slits to which each of said stress relieving slits extends is positioned intermediate said parallel lines of the respective flap.

14. A package according to claim 9 wherein each of said end slits is of arcuate configuration.

15. A package according to claim 9 wherein a pair of terminal slits are formed in each of said side walls and are disposed respectively at said extremities of said stress relieving slits in such a manner that said terminal slits respectively intersect said stress relieving slits, and said second fold line in each of said side walls interconnects said terminal slits in the respective side wall.

16. A package according to claim 9 wherein a pair of third fold lines are formed in each of said side walls, said third fold lines extending outwardly of said each side wall respectively from said extremities of said stress relieving slits toward said junction between the respective side wall and said top wall.

17. A package according to claim 16 wherein each of said third fold lines is disposed in substantially tangential relation with said circular perimeter of one of said ends of an adjacent one of said articles.

* * * * *